US008300073B2

(12) United States Patent
Inaba

(10) Patent No.: US 8,300,073 B2
(45) Date of Patent: Oct. 30, 2012

(54) PRINT APPARATUS AND CONTROL METHOD FOR THE SAME

(75) Inventor: Hiroyuki Inaba, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/715,601

(22) Filed: Mar. 2, 2010

(65) Prior Publication Data

US 2010/0238255 A1 Sep. 23, 2010

(30) Foreign Application Priority Data

Mar. 17, 2009 (JP) ..... 2009-065022

(51) Int. Cl.
*B41J 11/66* (2006.01)
*B41J 11/70* (2006.01)

(52) U.S. Cl. ..... 347/218; 346/24; 83/371

(58) Field of Classification Search ..... 347/218; 346/24; 400/621; 83/370, 371
See application file for complete search history.

(56) References Cited

U.S. PATENT DOCUMENTS

| | | | | |
|---|---|---|---|---|
| 4,147,080 | A * | 4/1979 | Diesch et al. | 83/371 |
| 4,900,174 | A * | 2/1990 | Didiergeorge | 400/621 |
| 8,043,993 | B2 * | 10/2011 | Roth et al. | 503/204 |
| 2005/0270357 | A1 * | 12/2005 | Kawai | 347/105 |
| 2010/0238253 | A1 * | 9/2010 | Inoue | 347/218 |

FOREIGN PATENT DOCUMENTS

| | | |
|---|---|---|
| JP | 06-011809 | 1/1994 |
| JP | 2002-361959 | 12/2002 |
| WO | WO 92/12054 | * 7/1992 |

* cited by examiner

*Primary Examiner* — Huan Tran
(74) *Attorney, Agent, or Firm* — Turocy & Watson, LLP

(57) ABSTRACT

One of mark sensors is automatically selected in accordance with specifications of a thermal sheet. A cutting position on the thermal sheet is decided on the basis of an output of the selected one mark sensor.

18 Claims, 4 Drawing Sheets

PRINT APPARATUS AND CONTROL METHOD FOR THE SAME

CROSS-REFERENCE TO RELATED APPLICATION

This application is based upon and claims the benefit of priority from the prior Japanese Patent Application No. 2009-065022 filed Mar. 17, 2009, the entire contents of which are incorporated herein by reference.

TECHNICAL FIELD

A disclosed embodiment of the present invention relates to a print apparatus having a thermal print function and a control method for the same.

BACKGROUND

A print apparatus having a thermal print function prints information on a thermal sheet while pulling out the forward edge of the thermal sheet that is rolled and then carrying the thermal sheet. The thermal sheet on which printing is finished is cut and the cut piece is discharged as a statement sheet.

On the back side of the thermal sheet, a mark which serves as a reference for deciding a cutting position is printed at predetermined intervals along the carrying direction of the thermal sheet. The print apparatus optically detects these marks and decides the cutting position on the thermal sheet on the basis of the detected position.

As an example of deciding the cutting position on a sheet on the basis of a barcode on the sheet, the technique described in JP-UM-B-6-11809 is known.

There are plural kinds of thermal sheets with different specifications. For example, there is a thermal sheet having a mark at an edge position and a central position in the direction of the width that is orthogonal to the carrying direction, a thermal sheet having a mark only at an edge position in the direction of the width, a thermal sheet having a mark only at a central position in the direction of the width, or the like.

In order to be able to cope with any of these thermal sheets, plural mark sensors need to be arrayed in the direction of the width that is orthogonal to the carrying direction of the thermal sheet. However, if plural mark sensors are provided, processing to detect the marks and processing to decide the cutting position become complicated.

As a measure to deal with the above, it is desirable to selectively use one of the mark sensors in accordance with the specifications of the thermal sheet. However, in this case, it is necessary to operate a changeover switch to select one of the sensors. This operation is very troublesome for users. Users may forget to carry out the operation. Users who are not familiar with this use may not even notice the existence of the changeover switch.

SUMMARY

A print apparatus according to an aspect of the invention includes:

a printer which prints information on a sheet while carrying the sheet;

a cutting section which cuts the sheet on which printing is carried out by the printer;

plural mark sensors provided along a direction orthogonal to a carrying direction of the sheet, the plural mark sensors detecting one or plural marks on the sheet; and a controller which carries the sheet and selects one of the mark sensors on the basis of an output of each of the mark sensors during the carrying, and which decides a cutting position on the sheet to be cut by the cutting section on the basis of the output of the selected mark sensor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION

Hereinafter, an embodiment of the invention will be described with reference to the drawings.

Figure 1:
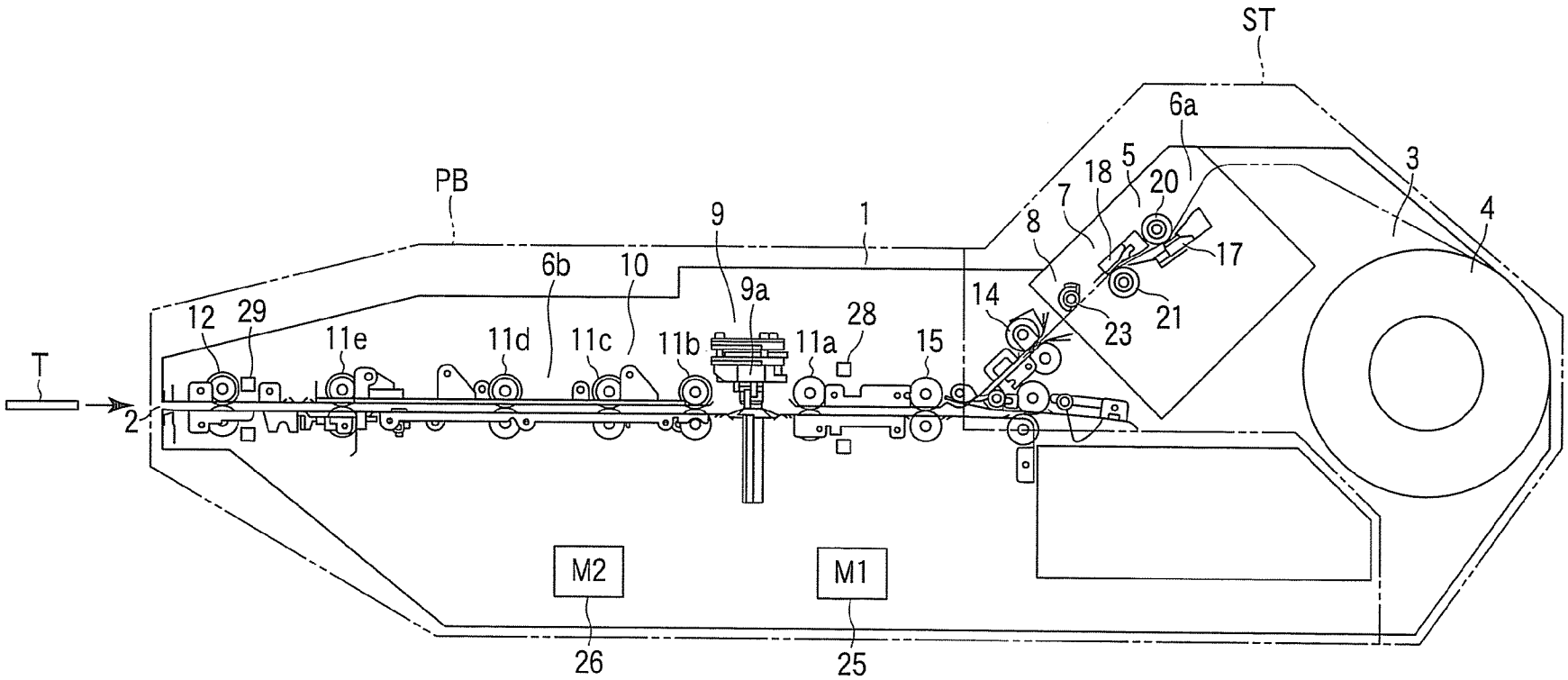
FIG. 1 shows the overall configuration of an embodiment of the invention.

As shown in FIG. 1, a print apparatus 1 has on its front side a fascia section 2 which functions both as an entrance and exit of a passbook T and as a discharge port of a statement sheet, and has a sheet setting section 3 on the rear side. In the sheet setting section 3, a rolled thermal sheet 4 is removably set. The set thermal sheet 4 has its forward edge pulled out by a carrying section 5 and is guided to a carrying path 6*a*. On the carrying path 6*a*, a thermal print section 7 and a cutting section 8 are provided.

The thermal print section 7 has a thermal head 17 for back-side print and a thermal head 18 for face-side print at positions with a predetermined space along the carrying direction of the thermal sheet 4. Platen rollers 20 and 21 are rotatably pressed in contact with the thermal heads 17 and 18. The thermal heads 17 and 18 and the platen rollers 20 and 21 nip and carry the thermal sheet 4. The thermal head 17 prints information on the back side of the carried thermal sheet 4. The thermal head 18 prints information on the face side of the carried thermal sheet 4.

The cutting section 8 has a rotary cutter 23 and cuts the printed thermal sheet 4 by the rotation of the rotary cutter 23. The cut piece becomes a statement sheet.

Also, a carrying section 10 is provided in the print apparatus 1. The carrying section 10 has a carrying path 6*b* connecting to the carrying path 6*a*, and carrying rollers 11*a* to 11*e*, entrance and exit rollers 12 and feed rollers 15 which are arranged on the carrying path 6*b*. The carrying section 10 carries the passbook T inserted into the fascia section 2 and also carries a statement sheet sent from the carrying path 6*a* to the fascia section 2. A dot print section 9 is provided between the carrying rollers 11*a* and 11*b* on the carrying path 6*b*. The dot print section 9 has a 24-pin dot matrix head 9*a*. The entrance and exit rollers 12 take in the passbook T inserted in the fascia section 2 and also send the passbook T and the statement sheet on which printing is finished, out of the fascia section 2.

Moreover, a sheet sensor 28 which detects the thermal sheet 4 is provided on the sheet introduction side of the carrying section 10. A passbook sensor 29 which detects the passbook T is provided near the entrance and exit rollers 12 in the carrying section 10.

Figure 2:
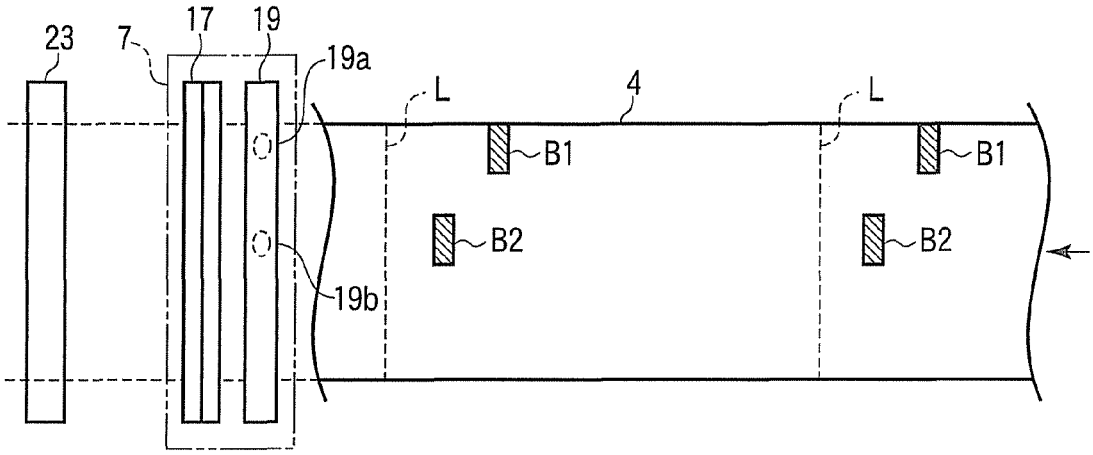
FIG. 2 shows the configuration of essential parts and a thermal sheet in the embodiment.

The thermal print section 7 has a black mark detection section 19 at a position before the thermal head 17 in the carrying direction of the thermal sheet 4, as shown in FIG. 2. The black mark detection section 19 has mark sensors at plural positions, for example, mark sensors 19*a* and 19*b* at two positions, in the direction of the width that is orthogonal to the carrying direction of the thermal sheet 4.

The mark sensor 19*a* optically detects a black mark B1 printed in advance on the back side of the thermal sheet 4. The black mark B1 is a mark made of a black block as a reference for deciding the cutting position by the cutting section 8. The black mark B1 is printed at edge positions in the direction of the width of the thermal sheet 4 and at predetermined intervals along the carrying direction.

The mark sensor 19*b* optically detects a black mark B2 printed in advance on the back side of the thermal sheet 4. The black mark B2, similar to the black mark B1, is a mark made of a black block as a reference for deciding the cutting position by the cutting section 8. The black mark B2 is printed at central positions in the direction of the width of the thermal sheet 4 and at predetermined intervals along the carrying direction. The position of the black marks B2 is ahead of each of the black marks B1 by a predetermined distance in the carrying direction of the thermal sheet 4.

Figure 3:
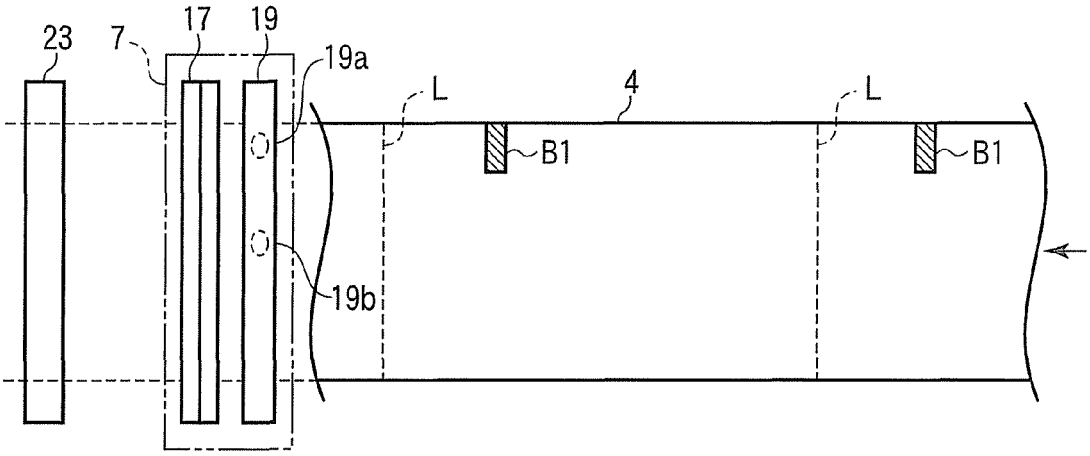
FIG. 3 shows a thermal sheet with another set of specifications in the embodiment.
Figure 4:
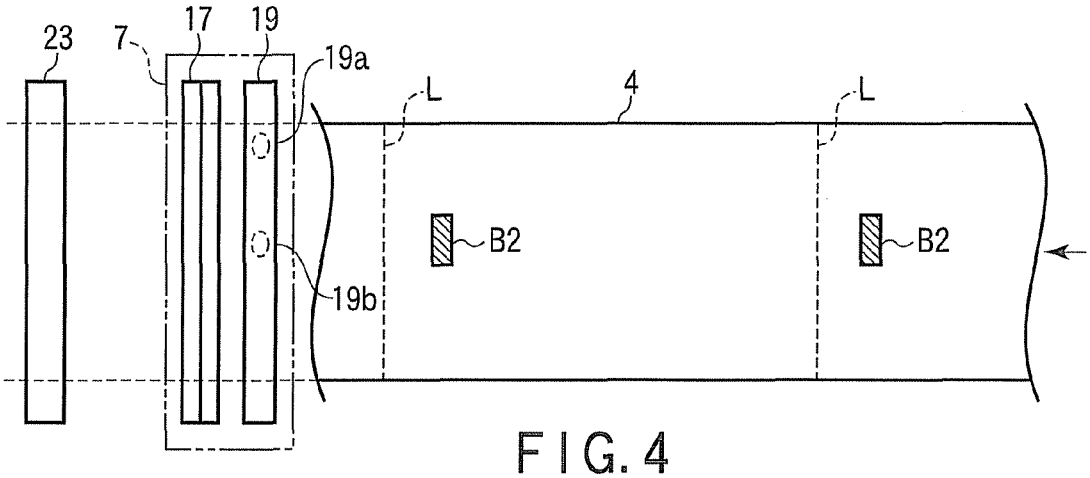
FIG. 4 shows a thermal sheet with still another set of specifications in the embodiment.

The thermal sheet 4 may have the specifications having only the black marks B1 as shown in FIG. 3 and the specifications having only the black marks B2 as shown in FIG. 4, as well as the specifications having the black marks B1 and B2 as shown in FIG. 2. Which specifications of the thermal sheet 4 should be employed is left to the user's selection.

The carrying section 5 has the platen rollers 20 and 21 which are rotatably pressed in contact with the thermal heads 17 and 18, and also has feed rollers 14 which send the statement sheet cut by the rotary cutter 23 to the carrying section 10. A motor 25 is provided for driving the platen rollers 20 and 21, the rotary cutter 23 and the feed rollers 14. Also, a motor 26 is provided for driving the carrying rollers 11*a* to 11*e*, the entrance and exit rollers 12 and the feed rollers 15 of the carrying section 10.

The sheet setting section 3, the carrying section 5, the carrying path 6*a*, the thermal print section 7, the cutting section 8 and the like constitute a statement printer (first printer) ST which prints information on the thermal sheet 4 while carrying the thermal sheet 4.

The carrying section 10 and its peripheral parts constitute a passbook printer (second printer) PB which prints information on the passbook T while carrying the passbook T. The passbook printer PB also has the function of carrying the statement sheet printed by the statement printer ST and then cut, to the fascia section 2.

Figure 5:
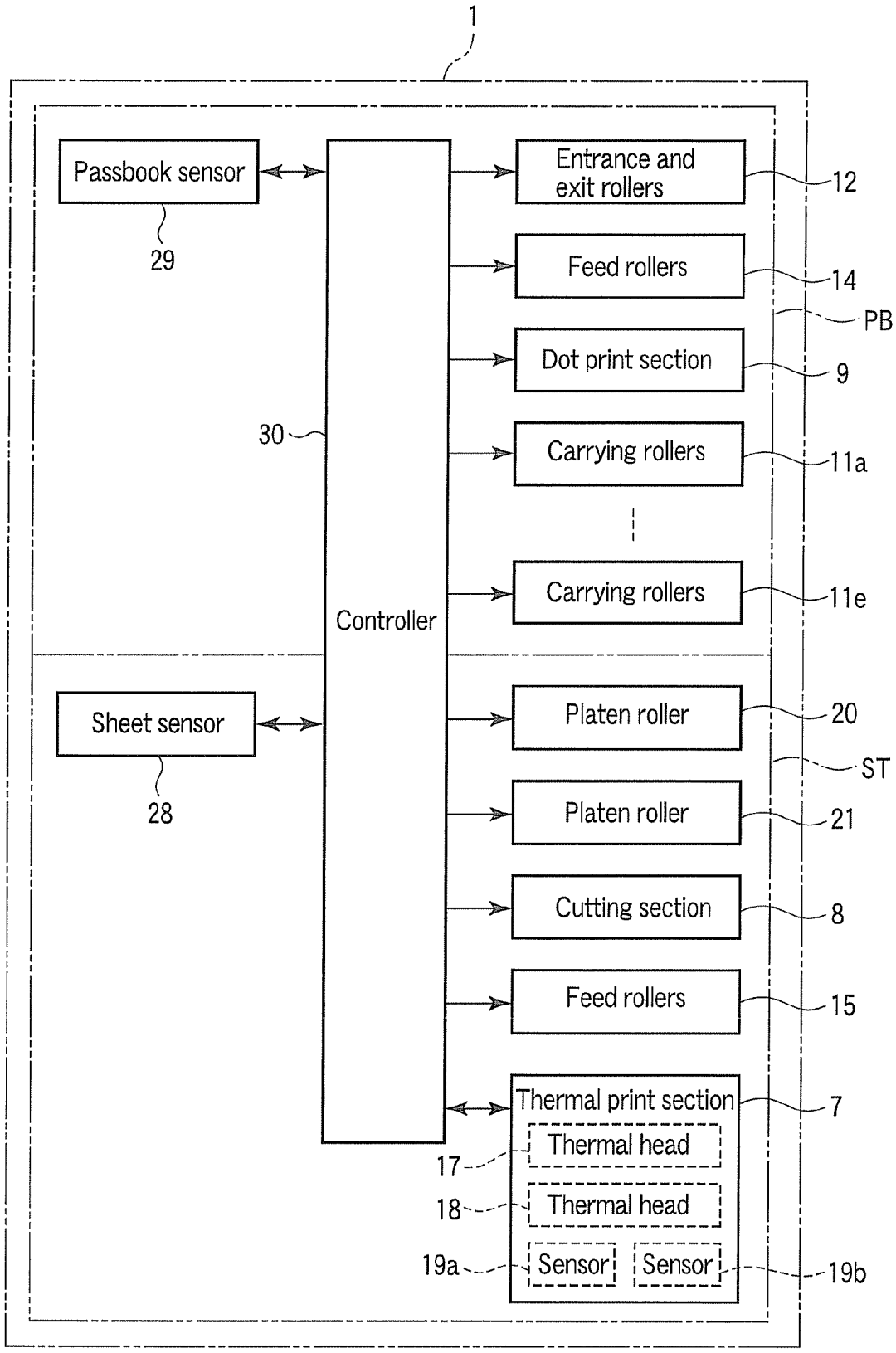
FIG. 5 is a block diagram showing a control circuit in the embodiment.

FIG. 5 shows a control circuit.

A controller 30 is provided to control the statement printer ST and to control the passbook printer PB. Components of the statement printer ST and components of the passbook printer PB are connected to the controller 30.

The controller 30 has the following sections (1) and (2) as its main functions.

(1) A selection section which carries the thermal sheet 4 and selects one of the mark sensors 19*a* and 19*b* on the basis of the output of the mark sensors 19*a* and 19*b* during the carrying. Specifically, when the thermal sheet 4 is set in the sheet setting section 3, the forward edge of the thermal sheet 4 is carried out a predetermined standby position, and of the mark sensors 19*a* and 19*b*, a mark sensor which outputs a mark detection signal first during the carrying is selected.

(2) A decision section which decides the cutting position on the thermal sheet 4 to be cut by the cutting section 8 on the basis of the output of the selected mark sensor.

Figure 6:
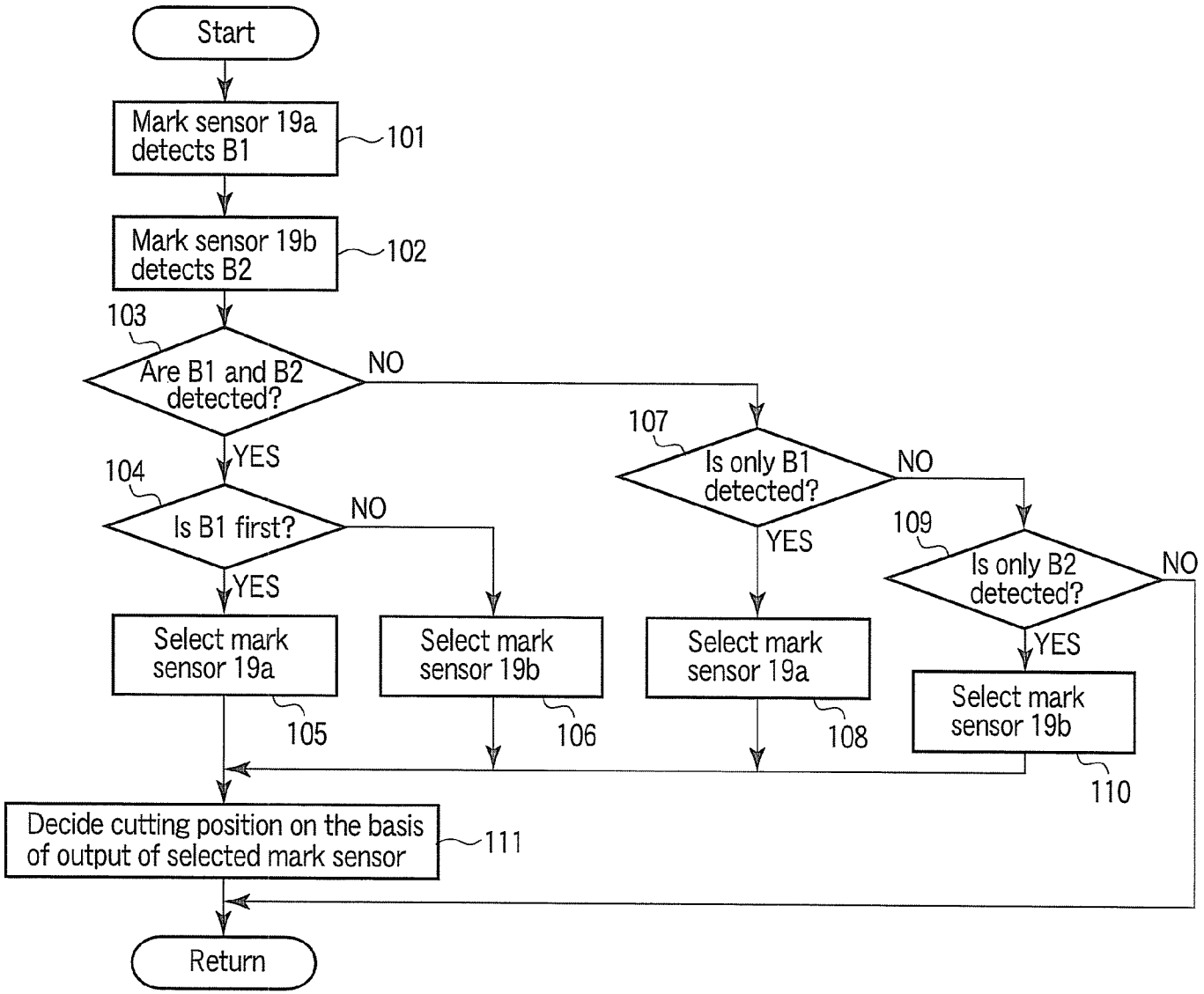
FIG. 6 is a flowchart for explaining the operation in the embodiment.

Next, the operation will be described with reference to the flowchart of FIG. 6.

In printing on the passbook T, the passbook printer PB operates. The passbook printer PB performs dot matrix print of information on the passbook T while carrying the passbook T.

In printing on the thermal sheet 4, the statement printer ST and the passbook printer PB operate. The statement printer ST prints information on the thermal sheet 4 while carrying the thermal sheet 4. The passbook printer PB carries the statement sheet printed by the statement printer ST and then cut, to the fascia section 2.

Meanwhile, when the thermal sheet 4 is set in the sheet setting section 3 by the user, the statement printer ST pulls out the forward edge of the thermal sheet 4 and carries the thermal sheet 4 to a predetermined standby position. During the carrying, the mark sensor 19*a* detects the black mark B1 (ACT 101) and the mark sensor 19*b* detects the black mark B2 (ACT 102).

If the thermal sheet 4 has specifications having both the black mark B1 and the black mark B2 as shown in FIG. 2, both the mark sensors 19*a* and 19*b* output a mark detection signal (YES in ACT 103). If both the mark sensors 19*a* and 19*b* output a mark detection signal (YES in ACT 103), the controller 30 determines which of the mark sensors 19*a* and 19*b* outputs a mark detection signal first (ACT 104).

If the mark sensor 19*a* outputs a mark detection signal first (YES in ACT 104), the controller 30 selects the mark sensor 19*a* as the mark sensor for deciding the cutting position (ACT 105). If the mark sensor 19*b* outputs a mark detection signal first (NO in ACT 104), the controller 30 selects the mark sensor 19*b* as the mark sensor for deciding the cutting position (ACT 106).

For example, if the thermal sheet 4 has the specifications of FIG. 2, the black marks B2 exists at a position preceding the black mark B1 and therefore the mark sensor 19*b* outputs a mark detection signal earlier. Thus, the controller 30 selects the mark sensor 19*b* as the sensor for deciding the cutting position.

If the thermal sheet 4 has specifications having only the black mark B1 as shown in FIG. 3, only the mark sensor 19*a* outputs a mark detection signal (NO in ACT 103, YES in ACT 107). In this case, the controller 30 selects the mark sensor 19*a* as the sensor for deciding the cutting position (ACT 108).

If the thermal sheet 4 has the specifications having only the black mark B2 as shown in FIG. 4, only the mark sensor 19*b* outputs a mark detection signal (NO in ACT 103, NO in ACT 107, YES in ACT 109). In this case, the controller 30 selects the mark sensor 19*b* as the sensor for deciding the cutting position (ACT 110).

The controller 30 holds the result of the selection until the next thermal sheet 4 is set in the sheet setting section 3.

Then the controller 30 decides the cutting position on the thermal sheet 4 to be cut by the cutting section 8 on the basis of the output of the selected mark sensor 19*a* or mark sensor 19*b* (ACT 111). For example, in the case of the thermal sheet 4 of FIG. 2, a cutting position L is decided with reference to the black mark B2. In the case of the thermal sheet 4 of FIG. 3, the cutting position L is decided with reference to the black mark B1. In the case of the thermal sheet 4 of FIG. 4, the cutting position L is decided with reference to the black mark B2.

In this manner, one of the plural mark sensors 19*a* and 19*b* is automatically selected in accordance with the specifications of the thermal sheet 4 and the cutting position L on the thermal sheet 4 is decided on the basis of the output of the selected one mark sensor. Thus, no changeover switch to selectively switch the mark sensors 19*a* and 19*b* is required and processing to detect each black mark and processing to decide the cutting position L are simplified. This simplification enables reduction in cost. Also, it is possible to allocate the controller 30 to other controls by the amount of this simplification.

In the embodiment, the case where the black mark detection section 19 has the two mark sensors 19*a* and 19*b* is described. However, the number of mark sensors and their arrangement may be properly selected in accordance with the specifications of the thermal sheet 4.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A print apparatus comprising:

a printer which prints information on a sheet while carrying the sheet;

a cutting section which cuts the sheet on which printing is carried out by the printer;

plural mark sensors provided along a direction orthogonal to a carrying direction of the sheet, the plural mark sensors detecting one or plural marks on the sheet; and a controller which carries the sheet and selects one of the mark sensors on the basis of an output of each of the mark sensors during the carrying, and which decides a cutting position on the sheet to be cut by the cutting section on the basis of the output of the selected mark sensor, wherein when the sheet is set, the controller carries the sheet to a predetermined standby position and selects one mark sensor, of the mark sensors, which outputs a mark detection first during the carrying.

2. The apparatus of claim 1, wherein the mark is a mark made up of a black block serving as a reference for deciding the cutting position on the sheet and is printed at one of an edge position and a central position in the direction orthogonal to the carrying direction of the sheet and at positions at predetermined intervals along the carrying direction of the sheet.

3. The apparatus of claim 1, wherein the sheet is a rolled thermal sheet.

4. The apparatus of claim 3, further comprising a sheet setting section for removably setting the thermal sheet therein.

5. The apparatus of claim 4, wherein the printer is a statement printer having at least one thermal head, and while pulling out a forward edge of the thermal sheet set in the sheet setting section and carrying the thermal sheet, the printer prints information on one of a face side and a back side of the thermal sheet.

6. The apparatus of claim 4, wherein when the thermal sheet is set in the sheet setting section, the controller carries a forward edge of the thermal sheet to a predetermined standby position and selects one mark sensor, of the mark sensors, which outputs a mark detection signal first during the carrying.

7. The apparatus of claim 6, wherein the controller holds a result of the selection until a next thermal sheet is set in the sheet setting section.

8. The apparatus of claim 6, further comprising a discharge port for discharging a cut piece of the thermal sheet that is cut by the cutting section.

9. A print apparatus comprising:

a first printer which prints information on a sheet while carrying the sheet;

a second printer which prints information on a passbook while carrying the passbook;

a cutting section which cuts the sheet on which printing is carried out by the first printer;

plural mark sensors provided along a direction orthogonal to a carrying direction of the sheet, the plural mark sensors detecting one or plural marks on the sheet; and a controller which carries the sheet and selects one of the mark sensors on the basis of an output of each of the mark sensors during the carrying, and which decides a cutting position on the sheet to be cut by the cutting section on the basis of the output of the selected mark sensor, wherein when the sheet is set, the controller carries the sheet to a predetermined standby position and selects one mark sensor, of the mark sensors, which outputs a mark detection signal first during the carrying.

10. The apparatus of claim 9, wherein the mark is a mark made up of a black block serving as a reference for deciding the cutting position on the sheet and is printed at one of an edge position and a central position in the direction orthogonal to the carrying direction of the sheet and at positions at predetermined intervals along the carrying direction of the sheet.

11. The apparatus of claim 9, wherein the sheet is a rolled thermal sheet.

12. The apparatus of claim 11, further comprising a sheet setting section for removably setting the thermal sheet therein.

13. The apparatus of claim 12, wherein the first printer is a statement printer having at least one thermal head, and while pulling out a forward edge of the thermal sheet set in the sheet setting section and carrying the thermal sheet, the first printer prints information on one of a face side and a back side of the thermal sheet, and the second printer is a passbook printer having a dot matrix head and prints information on the passbook while carrying the passbook.

14. The apparatus of claim 12, wherein when the thermal sheet is set in the sheet setting section, the controller carries a forward edge of the thermal sheet to a predetermined standby position and selects one mark sensor, of the mark sensors, which outputs a mark detection signal first during the carrying.

15. The apparatus of claim 14, wherein the controller holds a result of the selection until a next thermal sheet is set in the sheet setting section.

16. The apparatus of claim 14, further comprising a fascia section which functions both as a discharge port for discharging a cut piece of the thermal sheet that is cut by the cutting section and as an entrance and exit for taking in and out the passbook.

17. The apparatus of claim 16, wherein the second printer carries the cut piece of the thermal sheet cut by the cutting section to the fascia section.

18. A control method for a print apparatus including: a printer which prints information on a sheet while carrying the sheet; a cutting section which cuts the sheet on which printing is carried out by the printer; and plural mark sensors provided along a direction orthogonal to a carrying direction of the sheet, the plural mark sensors detecting one or plural marks on the sheet, the method comprising:

carrying the sheet and selecting one of the mark sensors on the basis of an output of each of the mark sensors during the carrying; and deciding a cutting position on the sheet to be cut by the cutting section on the basis of the output of the selected sensor, wherein when the sheet is set, the controller carries the sheet to a predetermined standby position and selects one mark sensor, of the mark sensors, which outputs a mark detection signal first during the carrying.

* * * * *